US006547033B1

(12) United States Patent
Cheval

(10) Patent No.: US 6,547,033 B1
(45) Date of Patent: Apr. 15, 2003

(54) SAFETY DEVICE

(75) Inventor: Alain Cheval, Lagny-sur-mare (FR)

(73) Assignee: Rollgliss AG, Zurich (CH)

( * ) Notice: Subject to any disclaimer, the term of this patent is extended or adjusted under 35 U.S.C. 154(b) by 0 days.

(21) Appl. No.: 08/803,685

(22) Filed: Feb. 21, 1997

(30) Foreign Application Priority Data

Apr. 18, 1996 (GB) ..... 9608018

(51) Int. Cl.[7] ..... A62B 35/00

(52) U.S. Cl. ..... 182/3; 182/45; 248/206.2; 248/363

(58) Field of Search ..... 182/3, 4, 36; 248/205.8, 248/205.9, 206.2, 206.3, 206.4, 309.3, 362, 363, 683; 269/21; 294/64.1, 64.2, 64.3, 65

(56) References Cited

U.S. PATENT DOCUMENTS 2,404,412 A * 7/1946 Stephens ..... 248/205.9
2,420,811 A * 5/1947 Brewster et al. ..... 248/205.8 X
2,749,097 A * 6/1956 Billner ..... 248/205.9 X
2,871,053 A * 1/1959 Richter ..... 248/205.8 X
2,968,460 A * 1/1961 Van Dusen ..... 248/205.8 X
3,568,959 A * 3/1971 Blatt ..... 294/64.2
3,613,904 A * 10/1971 Blatt ..... 294/64.2 X
3,863,568 A * 2/1975 Frederick ..... 248/205.8
3,910,620 A * 10/1975 Sperry ..... 248/362 X
4,196,882 A * 4/1980 Rognon ..... 248/205.9
4,295,543 A * 10/1981 Graham ..... 182/3
4,328,761 A * 5/1982 Dwyer ..... 248/363 X
4,709,782 A * 12/1987 Lipinski ..... 182/3
4,828,306 A * 5/1989 Blatt ..... 294/64.2
4,944,478 A * 7/1990 Sullivan ..... 248/362 X
4,971,591 A * 11/1990 Raviv et al. ..... 446/177
5,014,803 A * 5/1991 Urakami ..... 248/206.4 X
5,036,949 A * 8/1991 Crocker et al. ..... 182/3
5,092,426 A * 3/1992 Rhodes ..... 182/3
5,104,077 A * 4/1992 Liu ..... 248/363 X
5,143,170 A * 9/1992 Hunt et al. ..... 182/45 X
5,156,233 A * 10/1992 Olsen et al. ..... 182/3
5,201,560 A * 4/1993 Golden ..... 294/64.2
5,297,651 A * 3/1994 Vandelinde ..... 182/36 X
5,361,866 A * 11/1994 Bell et al. ..... 182/3
5,423,466 A * 6/1995 Moon ..... 248/205.8 X
5,492,141 A * 2/1996 Oberlander ..... 182/3 X
5,511,752 A * 4/1996 Trethewey ..... 248/362 X
5,526,896 A * 6/1996 O'Rourke ..... 182/3
5,529,144 A * 6/1996 Henderson ..... 182/3
5,685,513 A * 11/1997 Tsukushi ..... 248/362 X
5,711,397 A * 1/1998 Flora et al. ..... 182/3
5,730,246 A * 3/1998 Beard ..... 182/3 X

* cited by examiner

*Primary Examiner*—Daniel P. Stodola
(74) *Attorney, Agent, or Firm*—IPLM Group, P.A.

(57) ABSTRACT

A safety device is secured a person to a surface so that the person can safely move about the surface without falling. The device has an anchor which incorporates an attachment arrangement for a safety line. The anchor has a rigid element or plate which has a sealing element extending from one side of the plate to define a working volume. The working volume becomes a working chamber when the anchor is attached to a surface. A valve is provided for selectively connecting the working chamber to a vacuum source or to vent the working chamber to the atmosphere. The vacuum source is situated remotely from the anchor and is attached to the anchor by a vacuum supply line and a one way valve.

4 Claims, 7 Drawing Sheets

FIG. 1
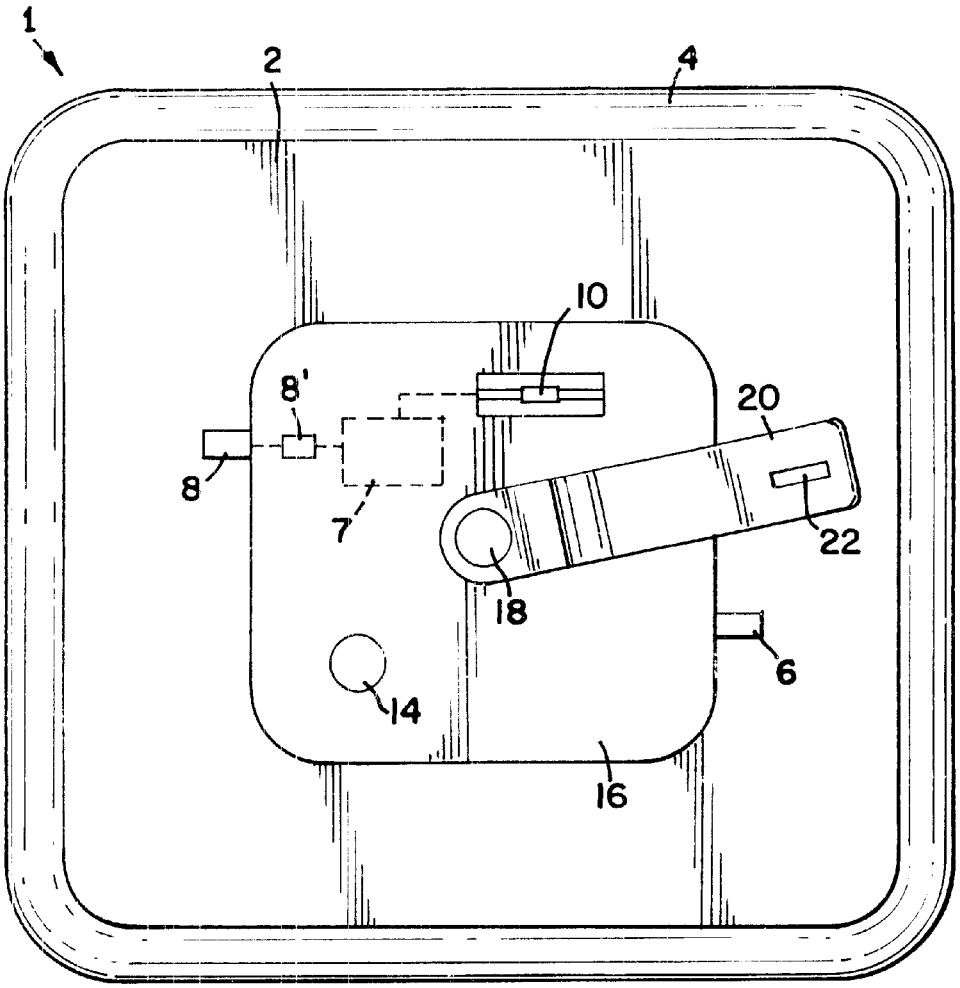
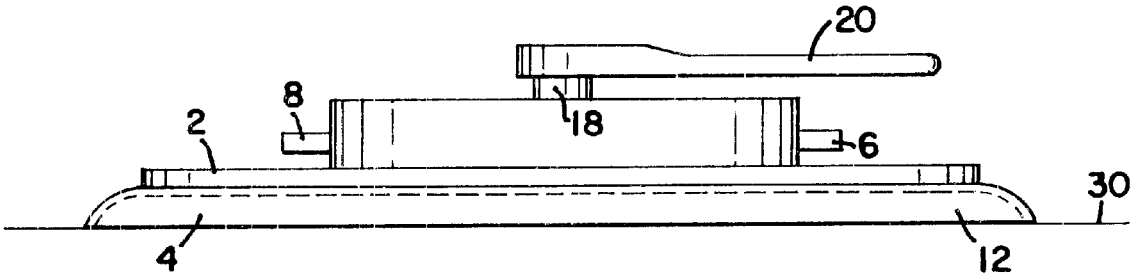
FIG. 2

SAFETY DEVICE

The present invention relates to a safety device, and in particular to a device enabling personal perform maintenance or inspection procedures on large items, such as the wing or tail sections of an aircraft, the sides of storage tanks, ships, submarines and other large structures.

Because of the large open spans required in hanger buildings suitable for large aircraft it is impractical to install fixed safely lines in these structures since the sag that would be induced in a line by the weight of a person falling and being arrested by the line could cause that person to strike a lower obstruction before their fall was arrested or to slide in an uncontrolled manner onto a protruding platform or lower part of an aircraft.

According to a first aspect of the present invention there is provided a safety device comprising an anchor which can be secured to a surface without damaging the surface, the anchor incorporating attachment means for attachment to a safety line.

It is thus possible to provide a safety device which can be positioned on a structure in the vicinity where a person is working thereby ensuring that the person is attached to the safety device by a relatively short safety line.

Preferably the anchor attaches to the surface by means of suction. Alternatively, other forms of attachment may be used, such as magnetic attraction generated by an electromagnet or a permanent magnet.

Preferably the anchor comprises a rigid element having a sealing clement extending from a first side thereof. The rigid clement may be formed as a plate. The sealing element may be formed as a seal extending around the periphery of the rigid element.

The plate may, for example, be circular or rectangular. A substantially square plate having chamfered corners has been found to be particularly useful in an embodiment of the present invention.

The plate is preferably made of a lightweight and strong material, such as aluminium or an aluminium alloy, as this enables a physically strong anchor to be formed which is still sufficiently light to be manually handled with ease. In an embodiment of the present invention, the plate is substantially 450 mm×450 mm with a thickness of approximately 10 mm. The plate may be planar or it may be curved in order to accommodate the curvature of a structure such as an aircraft fuselage. A planar plate may be used as an anchor on a curved fuselage provided that the radius of curvature is not too small. Similarly, a curved plate may be attachable to both a curved surface and a plane surface provided that the radius of curvature induced in the plate is not too small.

Advantageously, the seal is profiled to have a plurality of sealing lips. The provision of a plurality of lips provides enhanced integrity against gas leakage through the seal. In a preferred embodiment, the seal comprises a primary sealing lip and secondary, tertiary, and quaternary lips which act as backup seals.

Preferably, the seal is made of a rubber or rubber-like material. Nitrile rubber is especially preferred as it has excellent resistance to chemical attack from items such as fuel, skydrol or mineral based oils used in aircraft systems.

The plate and seal cooperate to define a working volume of the anchor. This working volume becomes a sealed working chamber when the anchor is attached to the surface.

Preferably, each anchor carries its own control valves. One or more valves may be attached to the rear surface of the plate. Advantageously, the valves are positioned in a protective enclosure so that the valves cannot be inadvertently operated, for example, by someone accidentally tripping over the anchor. The valve or valves are operable selectively to connect the working chamber to a vacuum source, or to vent the working chamber to the atmosphere. Advantageously the valve or valves may enable the working chamber to be isolated.

Preferably, each anchor comprises at least one coupling to enable it to be attached to or uncoupled from a vacuum supply line. Advantageously the couplings are quick release couplings. Preferably, each anchor carries two or more couplings in gas flow communication with one another such that a plurality of anchors may be connected together in series. Preferably, each coupling includes a self-sealing valve such that air is not admitted into the anchor in the event of accidental disconnection of a coupling.

Preferably, each anchor includes a vacuum reservoir. The reservoir can be selectively coupled to the working chamber of the anchor in order to reduce the gas pressure within the working chamber even when the vacuum supply to the anchor has been interrupted or removed.

Advantageously, the or each anchor carries a centrally mounted rotatable arm on its rear surface. The arm has an aperture formed therein for accepting a karabiner or other clip by which a connection can be made between the anchor and a safety line. The arm is rotatable thereby enabling a person to work safely within a predetermined radius of the anchor.

Alternatively, two anchors may be provided with a safety line that runs between them. A further safety line is then connected in sliding arrangement to the line secured between the two anchors. Such an arrangement enables a greater working area to be covered than is possible using a single anchor alone.

Preferably, one or more anchors are provided in combination with a substantially rigid track. Use of a rigid track reduces the shearing loads applied to the or each anchor when restraining a falling body. In a preferred embodiment, anchors are provided at opposing ends of track sections. Each track section is approximately 2.5 meters long and is provided with male and female ends, or another coupling arrangement, such that adjacent sections of track can be secured together. It is thus possible to form continuous track sections to any desired length. Advantageously, a carriage engages the track and is longitudinally moveable with respect thereto in order to give maintenance personnel easy access to a large area of structure whilst still providing excellent fall restraint.

Advantageously, a trolley is provided for storing the anchors or the track sections having anchors attached thereto. The trolley may also include a vacuum source together with flexible piping. The vacuum source may be driven from an electical supply, a compressed air supply, a hydraulic supply or an internal combustion engine. Advantageously, the vacuum source also includes a safety system which will give an audible and/or visible warning in the event of failure of the vacuum system and/or the vacuum pump power source.

According to a second aspect of the present invention, there is provided a fall arrest system comprising a plurality of track elements connectable together to form an elongate track and a carriage moveable along the track, the carriage having a connector for connection to a safety line, in which each track section has at least one vacuum anchor so that the track can be secured to the surface of a structure without substantially damaging the surface.

According to a third aspect of the present invention, there is provided a method of fall restraint comprising placing at least one vacuum anchor against a suitable surface, operating the anchor so as to secure it to the surface without damaging the surface and attaching a safety line to the anchor.

The present invention will be further described, by way of example, with reference to the accompanying drawings in which:

FIG. 1 is a plan view of an anchor constituting an embodiment of the present invention;

FIG. 2 is a side view of the anchor shown in FIG. 1 with a partial cross sectional view of working chamber 12;

Figure 9:
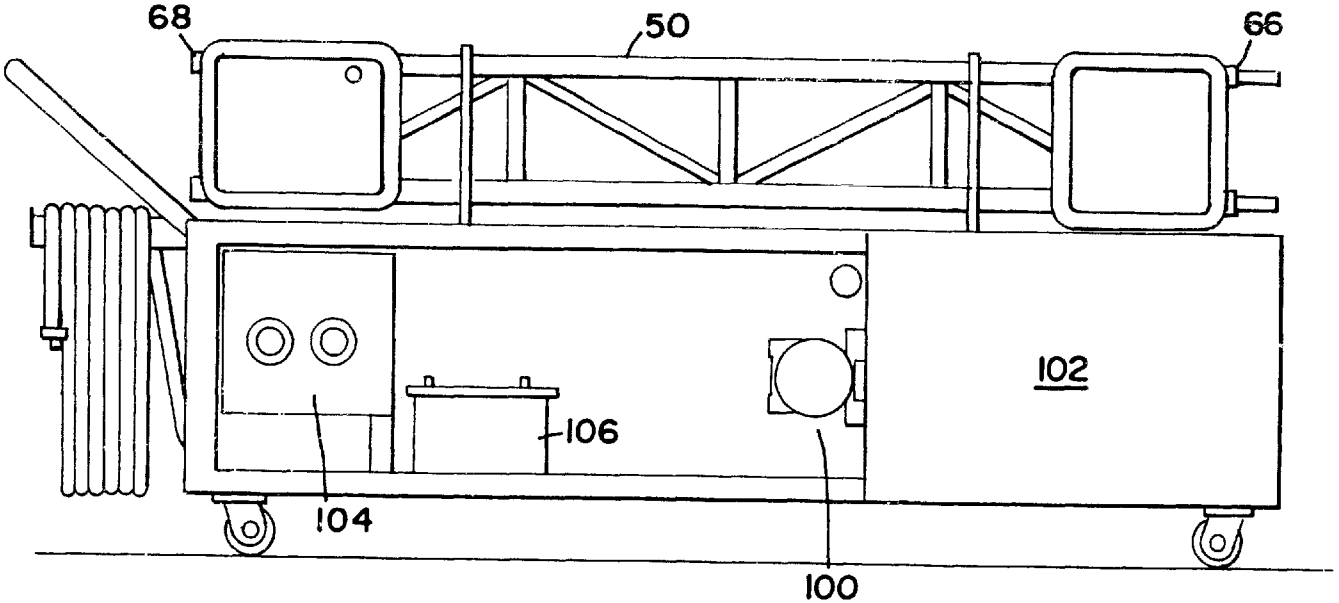
Figure 7:
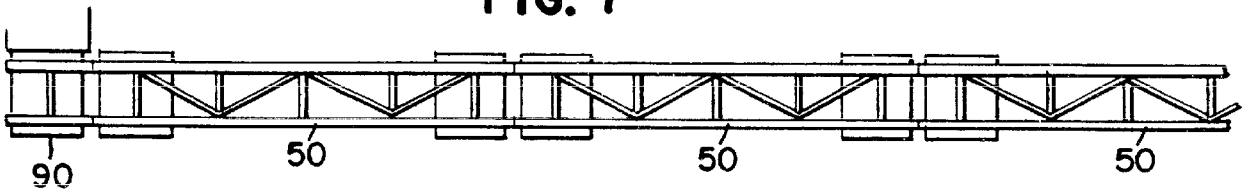
Figure 10:
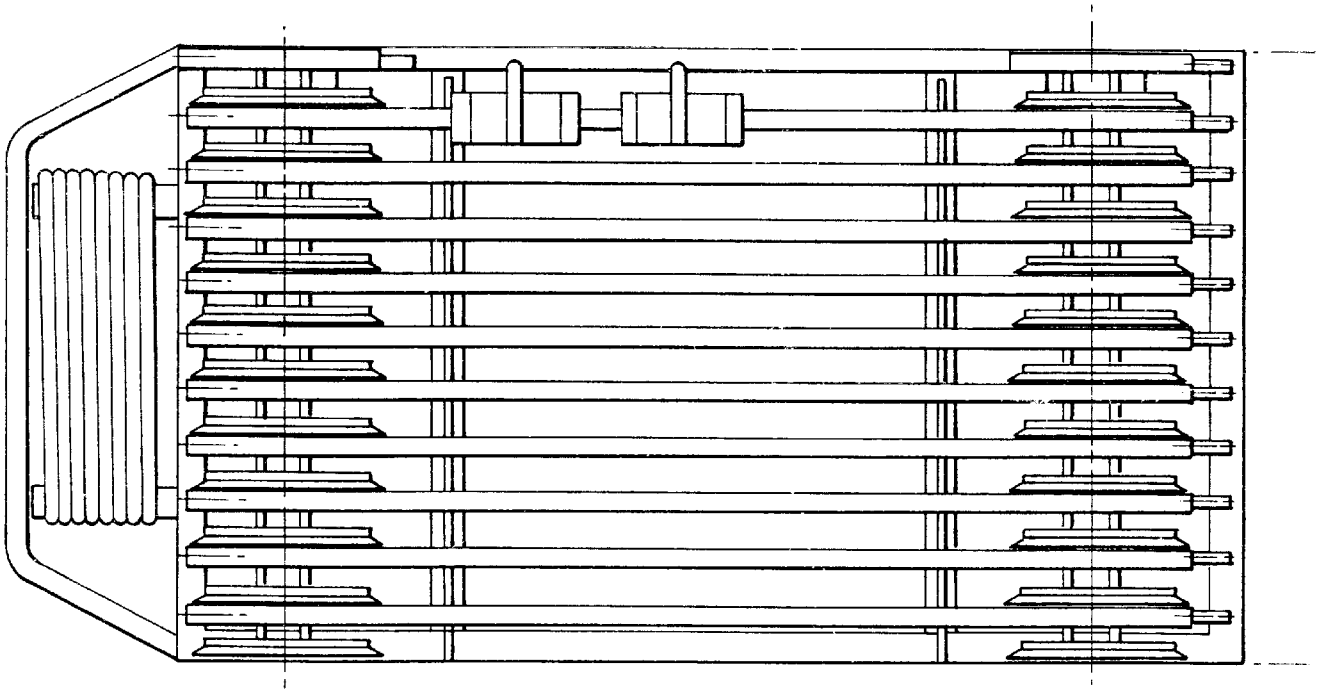
Figure 8:
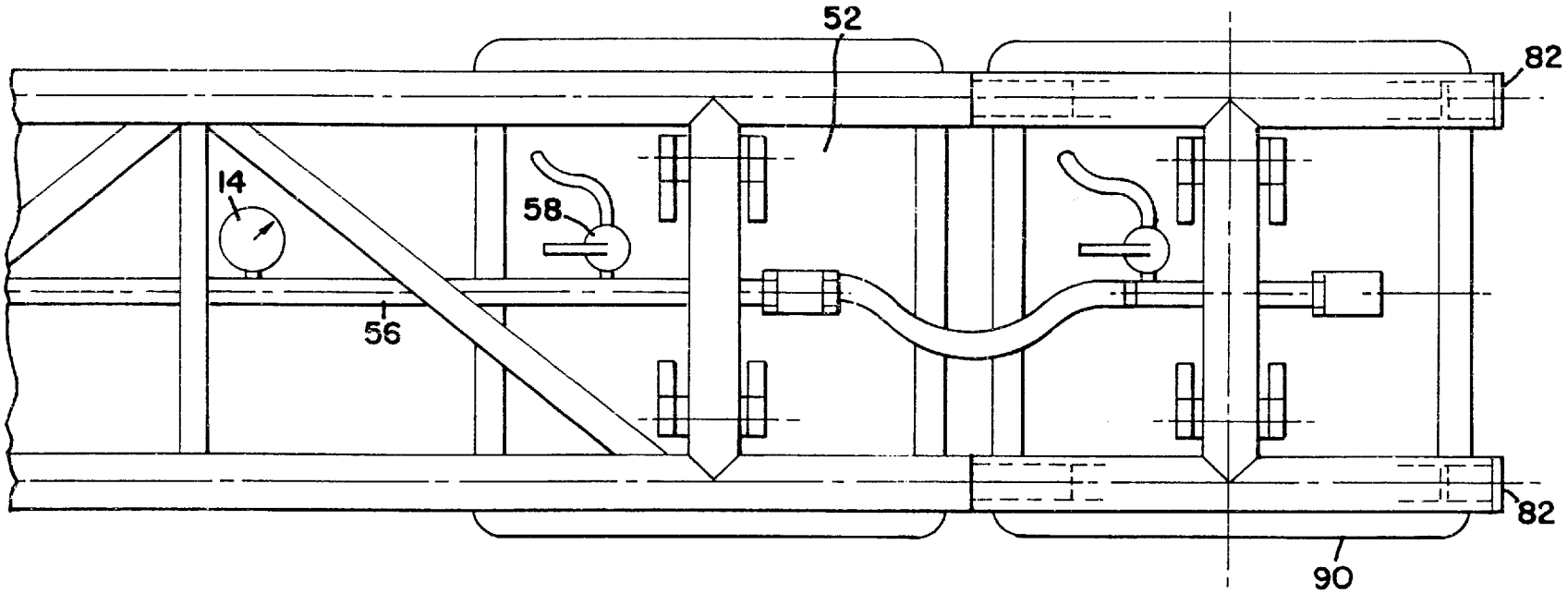

FIG. 7 schematically illustrates a plurality of frame sections assembled together;

FIG. 8 schematically illustrates an end of the safety system illustrated in FIG. 7;

FIG. 9 schematically illustrates the side view of a trolley for transporting the safety system shown FIG. 7;

FIG. 10 illustrates the trolley of FIG. 9 in plan view; and

Figure 11:
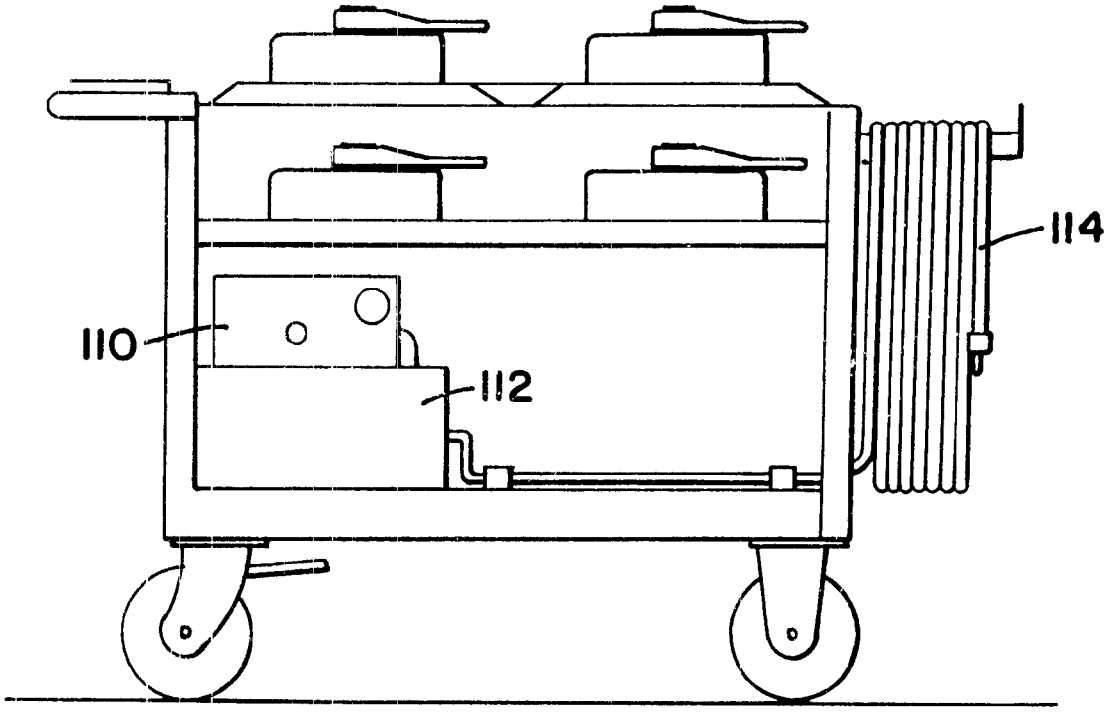

FIG. 11 schematically illustrates a trolley for a plurality of anchors of the type shown in FIG. 1.

The anchor 1 shown in FIG. 1 comprises a back-plate 2 which carries a nitrile rubber seal 4 around its periphery. The seal 4 has a dished profile and faces away from the plate 2. The rear surface of the plate 2 carries first and second quick-release vacuum couplers 6 and 8 which incorporate in-built check valves (one-way valves), and which are in gas flow communication with each other. A vacuum reservoir 7 is in gas flow communication via a one-way valve 8 with the couplers 6 and 8 such that the reservoir becomes evacuated when either of the couplers 6 and 8 is connected to a vacuum supply line. An outlet of the vacuum reservoir is connected via a manually operable valve 10 to a working volume or chamber 12 defined by the plate 2 and the seal 4. A pressure gauge 14 is in communication with the working volume 12 and measures the pressure therein. The connectors 6 and 8, the vacuum reservoir, the valve 10 and the pressure gauge 14 are covered by a second plate 16 to protect them from accidental damage. The second plate 16 is firmly secured to the plate 2 and has an upstanding pin 18 thereon which forms the pivot for a rotatable arm 20. The arm 20 has a recess 22 formed therein which acts as a point of attachment for a safety line.

In use, the anchor 1 is placed against a surface 30 (such as the exterior of an aircraft, ship, submarine, or storage tank), and a vacuum supply line is connected to one of the couplers 6 and 8. This causes the reservoir to become evacuated. Once the anchor has been placed at the desired position, the valve 10 is then opened so as to connect the working chamber 12 formed by the back plate, the seal and the surface to the vacuum supply line via the vacuum reservoir. The seal 4 makes a gas tight seal with the surface 30 and consequently the pressure within the working chamber 12 becomes reduced causing the anchor to be held against the surface 30 by virtue of the atmospheric pressure acting on the plate 2. Once the anchor has become secured to the surface 30, a safety line can be attached to the arm 20. The valve can be left open so as to provide a continuous path to vacuum (via the various one-way valves) so that minor leaks do not cause the anchors to release from the surface.

The anchor has dimensions of approximately 450 mm×450 mm. However, the distance between the innermost sealing lips of the anchor seals is approximately 400 mm. When the working volume is evacuated to a vacuum level of substantially 150 mBar. The force required to pull the anchor away from the surface 30 is approximately 1500 daN, i.e. equivalent to 1500 Kg force. The maximum shear load that the anchor can withstand before moving is dictated by the coefficient of friction between the rubber and the surface 30. However, typically the coefficient between rubber and a clean aluminium surface (i.e. the skin of an aircraft) is $\mu$=0.55. Thus, the anchor is able to stand a shearing force in the region of 800 daN.

The pressure gauge 14 is calibrated to show the level of vacuum but the face is also divided into a red portion and a green portion. The needle of the pressure gauge does not become aligned with the green portion until the vacuum level is down to approximately 300 mBar. The anchor should not be used until such a level of vacuum has been achieved.

Figure 3:
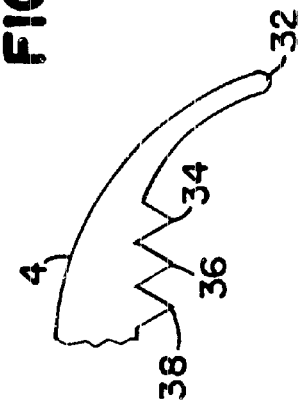
FIG. 3 is a cross-section through the seal of the anchor shown in FIG. 1.

FIG. 3 schematically shows the cross-section of the seal 4 in greater detail. The seal has a primary outer lip 32 which forms the main seal between the anchor 1 and the surface 30. However, the seal 4 is also provided with secondary, tertiary and quaternary lips 34,36 and 38 respectively, which provide backup seals in the event that the primary seal 32 is breaches. It will be appreciated that the anchor can be used if any one of the four sealing elements 32, 34, 36, and 38 is intact. Furthermore, the anchor is still useable if all of the sealing elements 32, 34, 36 and 38 are damaged provided that the breaches occur at different circumferential positions around the seal. Under such circumstances, the seal can still function as a labyrinth seal in order to maintain the vacuum within the working volume 12.

Figure 4:
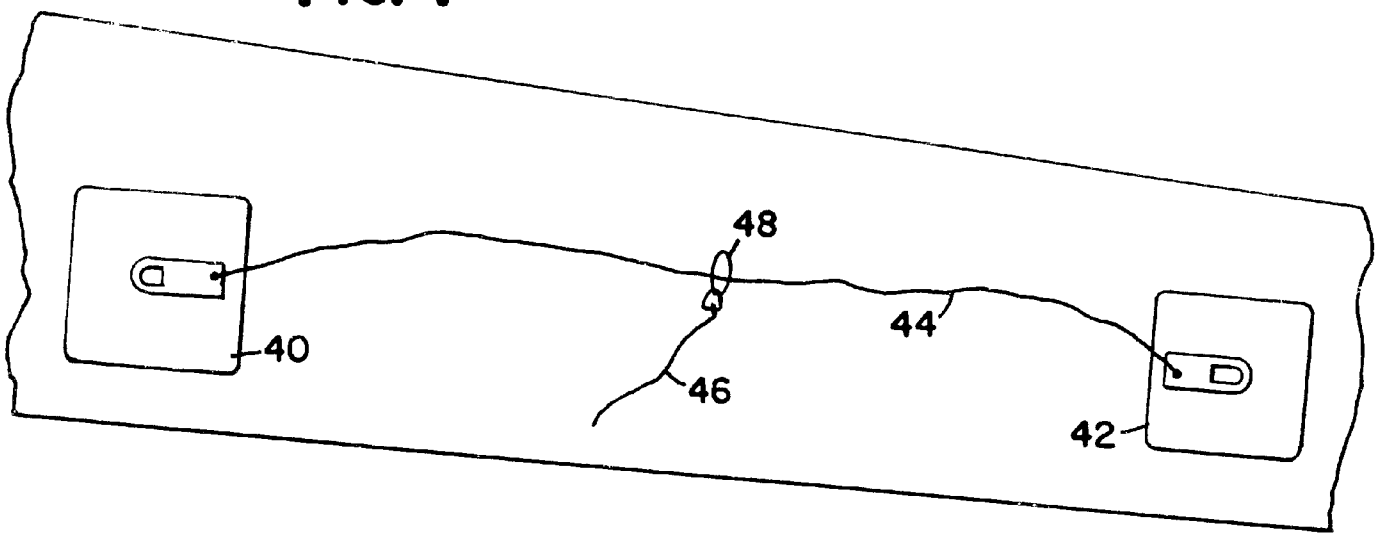
FIG. 4 is a schematic diagram of a safety system using two anchors tethered together.

FIG. 4 schematically illustrates a fall restraint system comprising two vacuum anchors. The vacuum anchors 40 and 42 arc tethered together via a flexible safety line 44. A further safety line 46 connected to a proprietary safety harness (not shown) is connected to the safety line 44 via a karabiner 48. Typically the safety line 46 is 1.8 meter lanyard fitted with a built-in shock absorber comprising a folded portion of webbing stitched to itself with severable stitching. The lanyard is designed such that the stitching fails when the load on the lanyard is in the region of 500 Kg. This allows the web portion to unravel and the energy of the falling person is dissipated during the process of breaking the stitching. Thus, the load applied transversely to the line interconnecting the vacuum anchors 40 and 42 is limited to approximately 500 Kg. It will be appreciated that the transverse load is converted by the safety line 44 into a substantially longitudinally acting shear force. The magnitude of the force is dependent upon how much the line 44 can be deviated from the straight line path between the anchors 40 and 42 before the line 44 becomes taut. Resolving the loads into a triangle of forces indicates that the safety line should be sufficiently slack in order that it can assume an angle of at least 30° with respect to the nominal line interconnecting the vacuum anchors.

The applicants realized that the load carrying capability of the safety system could be further enhanced if the connection between adjacent anchors did not flex to any substantial extent when it was loaded.

Figure 5:
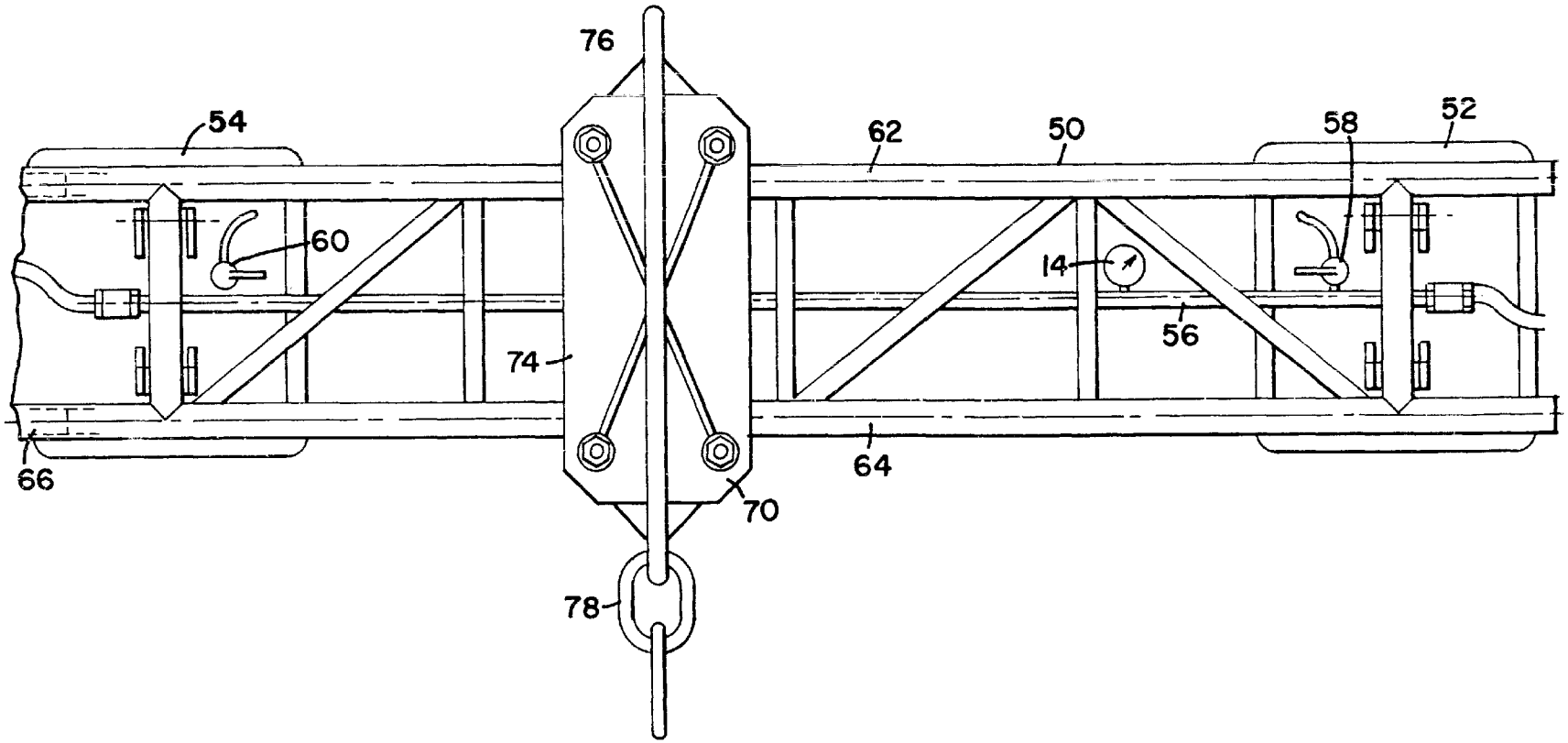
FIG. 5 is a plan view of a frame section of a safety system constituting a second embodiment of the present invention.

FIG. 5 schematically illustrates a further embodiment of the present invention in which a track 50 interconnects pairs of vacuum anchors 52 and 54. The anchors 52 and 54 are similar to the anchor shown in FIG. 1, although the rotatable arm 20 has been replaced by fixed joints to the frame 50.

Additionally, each anchor now only carries one releasible vacuum coupling, and a fixed vacuum line 56 now extends between the anchor 52 and 54.

Figure 6:
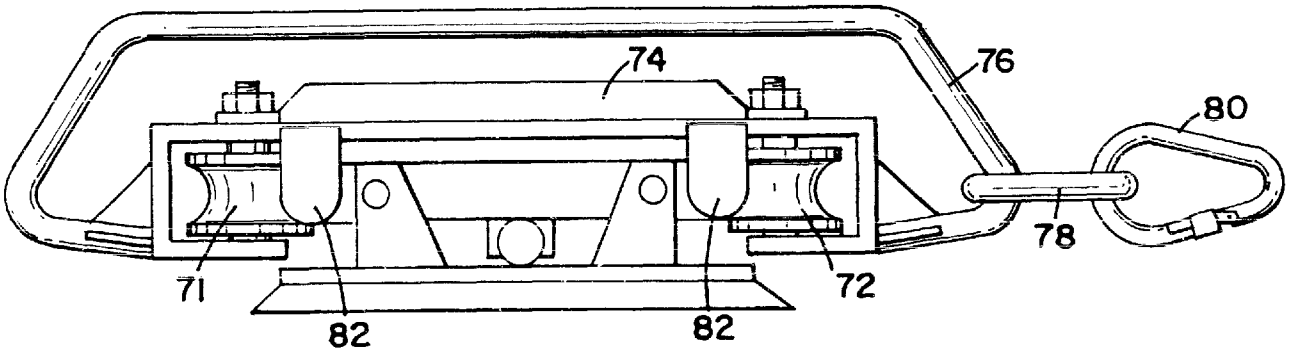
FIG. 6 is a cross-section through the carriage shown in FIG. 5.

The line 56 carries a single vacuum gauge for the assembly and the vacuum reservoirs have been omitted (although they can be retained). However, the line 56 (which has check valves at each end) effectively acts as a vacuum reservoir. Each anchor 52 and 54 is fitted with a vacuum gauge, a check valve, and has a manually operated valve 58 and 60 respectively, which can be operated to evacuate the working space of each anchor or to allow the working space to be vented to atmospheric pressure. The track 50 comprises two parallel rails 62 and 64 which are held in spaced relationship and against flexing by a plurality of cross members. The opposing ends of the rails are profiled such that one end forms a male connector 66 and the other end forms a female connector 68 (as illustrated in FIG. 9). A carriage 70 is provided in sliding engagement with the rails 62 and 64. The carriage is shown in greater detail in FIG. 6. The carriage comprises opposed pairs of guide wheels 71 and 72 which are held in engagement with the tracks 62 and 64 by a metal frame 74. A substantially D-shaped guide ring 76 extends from one side of the carriage to the other, and carries a sliding link 78 thereon. A karabiner 80 of a safety lanyard can be attached to the link 78 in order to secure a work person to the safety system.

FIG. 8 illustrates an end section of the safety system. The end sections additionally carry buffer plates 82 which act to prevent the carriage 70 from sliding off the end of the rails.

Each track section is approximately 2.5 meters long. A plurality of track sections 50 can be joined end-to-end, as shown in FIG. 7, to form an elongate section of track. As noted hereinabove, the tracks are provided with male and female end connectors such that the tracks firmly engage one another and a load borne by one track can be substantially supported by an adjacent track section. As an alternative to profiling the ends of each track so as to form male and female connectors, the ends may be identical and back-to-back connectors may be provided for securing adjacent sections of track to one another. As shown in FIG. 7, the end-most element of the completed assembly comprises an end anchor 90. Thus, the anchors occur in pairs and each pair is separated from a neighbouring pair by a track element. It should be noted that two end anchors 90 could be joined together to form a short complete track. The end anchor 90 is illustrated in greater detail in FIG. 8. The construction of the anchor 90 is identical to the construction of anchors 52 and 54 in the track section. However, the anchor 90 is only provided with a short section of track approximately 45 cm long and the track is provided with the buffers 82. Once the work has been completed, the anchors can be released by venting them to atmosphere.

FIG. 9 illustrates a trolley for carrying a plurality of frame sections. The trolley includes a vacuum source 100 in the form of a vacuum pump and a vacuum reservoir 102. As shown, the pump 100 is electrically operated and is controlled by a switch 104. A backup supply 106 in the form of a battery is also provided to operate an alarm system in the event that the mains power fails. The alarm system may include a klaxon or other audible indicator to warn of a power supply failure or loss of vacuum. The trolley can support a plurality of frame sections, as shown in the plan view of FIG. 10 together with sufficient vacuum hose to connect the trolley to the first of the frame sections.

Depending upon the operator's requirements, the trolley may also include an internal combustion engine, either coupled to a generator or directly coupled to a vacuum pump, or a compressed air vacuum generator.

A similar design of trolley may also be provided to carry the single vacuum anchor units of the type shown in FIG. 1. Such a trolley is illustrated in FIG. 11 and includes storage for a plurality of anchors, a source of vacuum comprising a pump 110 and reservoir 112 together with vacuum line 114 for interconnecting the anchors to the trolley and the anchors to one another.

In use, it is advantageous to check that each anchor is safely positioned over a surface and that air is not leaking past the seal or through a fracture or defect in the surface. In order to check the functionality of the system, each anchor is placed on the surface and connected to the vacuum supply. The valve on the anchor is then operated to the "HOLD" position so as to attach the anchor to the surface. The vacuum gauge should immediately register in the green segment of the dial. The vacuum hose is then disconnected and the vacuum level shown on the gauge should not fall. If the vacuum level does decrease (noticeably within approximately thirty seconds), the anchor should not be used. Inspection may reveal debris breaking the seal or rivet holes in the surface.

It is thus possible to provide a safety system for restraining falls in which vacuum operated anchors can be attached to the surface of a structure such as an aircraft wing, fuselage or tailplane without damage to the surface. Additionally, the anchors can be interconnected by rigid rails to form an elongate track allowing ease of movement along the structure while enabling a short length of safety line to be used, thereby decreasing the risk of injury in a fall.

What is claimed is:

1. A method of connecting a person relative to a support structure for fall protection purposes, comprising the steps of:

providing at least one portable anchor adapted to engage a surface on the support structure in a manner that defines a respective chamber;

imposing a connecting force between said at least one portable anchor and the surface without penetrating the surface by establishing a suction force inside the chamber;

interconnecting a safety line between said at least one portable anchor and the person; and maintaining a low pressure source in communication with the chamber after establishing the suction force.

2. A method of connecting a person relative to a support structure for fall protection purposes, comprising the steps of:

providing at least one portable anchor adapted to engage a surface on the support structure in a manner that defines a respective chamber;

imposing a connecting force between said at least one portable anchor and the surface without penetrating the surface by establishing a suction force inside the chamber to withstand approximately 1500 kilograms of pulling force exerted in a direction perpendicular to the surface; and interconnecting a safety line between said at least one portable anchor and the person.

3. A method of connecting a person relative to a support structure for fall protection purposes, comprising the steps of:

providing at least one portable anchor adapted to engage a surface on the support structure in a manner that defines a respective chamber;

imposing a connecting force between said at least one portable anchor and the surface without penetrating the surface by establishing a suction force inside the chamber to withstand at least 500 kilograms of shear force exerted in a direction parallel to the surface; and interconnecting a safety line between said at least one portable anchor and the person.

4. A method of connecting a person relative to a support structure for fall protection purposes, comprising the steps of:

providing at least one portable anchor with multiple, concentric sealing lips adapted to engage a surface on the support structure in a manner that defines a chamber and a plurality of seals about the chamber;

imposing a connecting force between said at least one portable anchor and the surface without penetrating the surface by establishing a suction force inside the chamber; and interconnecting a safety line between said at least one portable anchor and the person.

* * * * *

UNITED STATES PATENT AND TRADEMARK OFFICE

CERTIFICATE OF CORRECTION

PATENT NO. : 6,547,033 B1
DATED : April 15, 2003
INVENTOR(S) : Alain Cheval

It is certified that error appears in the above-identified patent and that said Letters Patent is hereby corrected as shown below:

Column 1,
Line 2, delete “personal” and insert therefore -- personnel to --
Line 9, insert -- , -- after “aircraft”
Lines 30 and 31, delete “clement” and insert therefore -- element --
Line 43, delete “mmx450” and insert therefore -- mm x 450 --

Column 3,
Line 36, delete “8” and insert therefore -- 8' --

Column 4,
Line 2, delete “mmx450” and insert therefore -- mm x 450 --
Line 27, delete “breaches” and insert therefore -- breached --
Line 40, delete “meter” and insert therefore -- metre --

Column 5,
Line 29, delete “meters” and insert therefore -- metres --

Signed and Sealed this

Fourteenth Day of October, 2003

JAMES E. ROGAN
*Director of the United States Patent and Trademark Office*